US007001249B1

(12) United States Patent
Pride et al.

(10) Patent No.: US 7,001,249 B1
(45) Date of Patent: Feb. 21, 2006

(54) METHODS AND SYSTEMS FOR FINISHING EDGES OF GLASS SHEETS

(75) Inventors: Thomas E. Pride, DeWitt, IA (US); Charles J. Beatty, Grand Rapids, MI (US)

(73) Assignees: Guardian Industries, Inc., Auburn Hills, MI (US); deMegBriErin, Inc., Grand Rapids, MI (US)

( * ) Notice: Subject to any disclaimer, the term of this patent is extended or adjusted under 35 U.S.C. 154(b) by 0 days.

(21) Appl. No.: 11/032,028

(22) Filed: Jan. 11, 2005

(51) Int. Cl.
*B24B 49/00* (2006.01)

(52) U.S. Cl. ..... 451/21; 451/44; 451/58; 451/336; 451/190

(58) Field of Classification Search ..... 451/44, 451/58, 336, 190, 256, 255, 130, 167, 41, 451/57, 261, 262, 21, 43
See application file for complete search history.

(56) References Cited

U.S. PATENT DOCUMENTS 2,170,687 A * 8/1939 Johnson ..... 144/135.3
4,594,814 A * 6/1986 Olszewski et al. ..... 451/44
5,613,894 A * 3/1997 Delle Vedove ..... 451/1
5,964,647 A * 10/1999 Henky ..... 451/43
6,325,704 B1 12/2001 Brown et al.
6,685,541 B1 2/2004 Brown et al.
6,796,886 B1 * 9/2004 Bushell ..... 451/182

* cited by examiner

*Primary Examiner*—George Nguyen
(74) *Attorney, Agent, or Firm*—Nixon & Vanderhye PC

(57) ABSTRACT

Methods and systems are disclosed whereby the edges of a glass sheet may be beveled with minimal equipment down time. Preferably such methods and systems bevel the upper and lower edges along lateral sides of a glass sheet. In especially preferred embodiments, laterally separated pairs of upper and lower edge grinding assemblies are provided having respective upper and lower oppositely oriented tapered grinding wheels. A glass sheet may thus be moved in a generally horizontal conveyance direction between one of these pairs of upper and lower edge grinding assemblies so that respective upper or lower lateral edges of the glass sheet are brought into grinding contact therewith. Continually moving the glass sheet in the horizontal conveyance direction will therefore present the other lateral edge to the other pair of upper or lower edge grinding assemblies positioned downstream. As such, the other edge will then be beveled. By independently mounting the oppositely oriented grinding wheels for independent movements both horizontally and vertically relative to the glass sheet, a fresh unscored region of the tapered grinding surfaces can then be presented to the glass sheet edges thereby ensuring that the proper bevel angle is achieved.

16 Claims, 4 Drawing Sheets

METHODS AND SYSTEMS FOR FINISHING EDGES OF GLASS SHEETS

FIELD OF THE INVENTION

The present invention relates generally to finishing edges of glass sheets. In especially preferred embodiments, the present invention relates to methods and systems whereby the lateral edges of glass sheets may be beveled.

BACKGROUND AND SUMMARY OF THE INVENTION

The edges of glass sheets are conventionally finished by passing the glass sheet edges through a V-shaped groove of a grinding wheel. See in this regard, U.S. Pat. No. 6,685,541 to Brown et al (the entire content of which is expressly incorporated hereinto by reference). One major problem with conventional V-grooved grinding wheels is that over time the glass edges gouge the grinding surface creating circumferential score lines therein. If left unchecked, the grinding wheels are incapable of forming an edge bevel on the glass sheet at the desired angle. As a result, the grinding wheels must periodically be removed so that the grinding surface of the V-groove can be dressed to thereby remove the score lines and reestablish the desired taper angle, following which the grinding wheel can again be placed back into service. Suffice it to say, the removal, dressing and replacement of conventional V-grooved grinding wheels contributes to considerable equipment downtime and concomitant loss of productivity.

It would therefore be highly desirable if methods and systems could be provided which minimized equipment down time associated with redressing of grinding wheels. It would especially be desirable if a greater amount of the grinding wheel's tapered surface could be utilized before it is necessary to remove the grinding wheel for redressing. It is towards fulfilling such needs that the present invention is directed.

Broadly, the present invention is directed toward grinding methods and systems whereby the edges of a glass sheet may be beveled with minimal equipment down time. More specifically, according to the present invention methods and systems for beveling upper and lower edges along lateral sides of a glass sheet are provided. In especially preferred embodiments, the present invention includes laterally separated pairs of upper and lower edge grinding assemblies having respective upper and lower oppositely oriented tapered grinding wheels. A glass sheet may thus be moved in a generally horizontal conveyance direction between one of these pairs of upper and lower edge grinding assemblies so that respective upper or lower lateral edges of the glass sheet are brought into grinding contact therewith. Continually moving the glass sheet in the horizontal conveyance direction will therefore present the other lateral edge to the other pair of upper or lower edge grinding assemblies positioned downstream. As such, the other edge will then be beveled.

Over time, a circumferential scored groove will be formed on the tapered grinding surface of at least one of said upper and lower tapered grinding wheels. By mounting the oppositely oriented grinding wheels for independent movements both horizontally and vertically relative to the glass sheet, a fresh unscored region of the tapered grinding surface can then be presented to the glass sheet edges thereby ensuring that the proper bevel angle is achieved. This adjustable movement of the grinding wheel(s) may be further repeated until there no longer remains a meaningful amount of fresh unscored surface regions. At such time, therefore, the worn grinding wheel may be replaced so that its tapered grinding surface may be redressed. However, as compared to the duty cycle of conventional V-shaped grinding wheels, the adjustability of the grinding wheels in accordance with the present invention means that a significantly longer duty cycle can be achieved prior to grinding wheel redressing and replacement thereby enhancing productivity of the glass finishing line.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
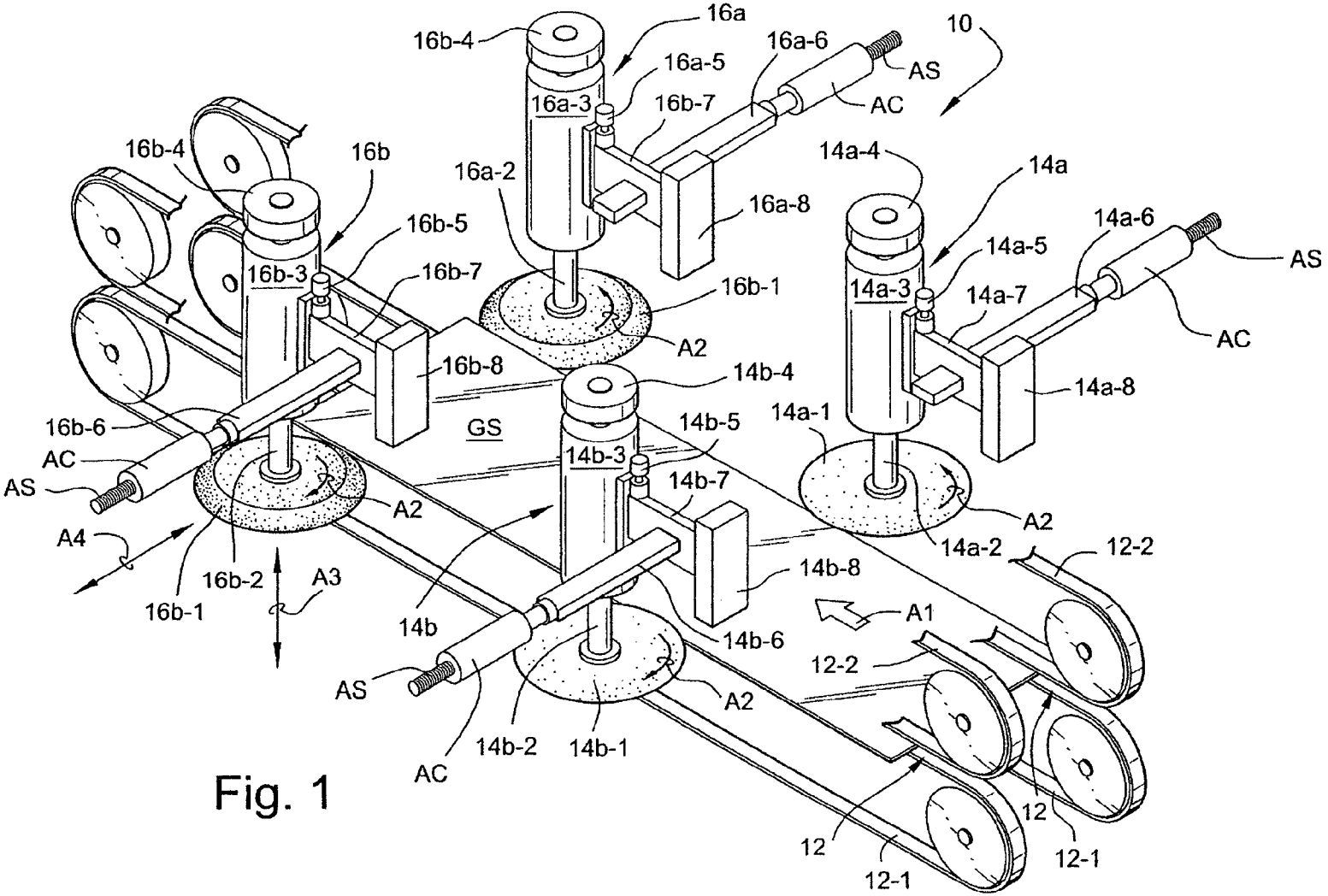
FIG. 1 is a perspective schematic view showing one preferred system for grinding the edges of glass sheets in accordance with the present invention.
Figure 2:
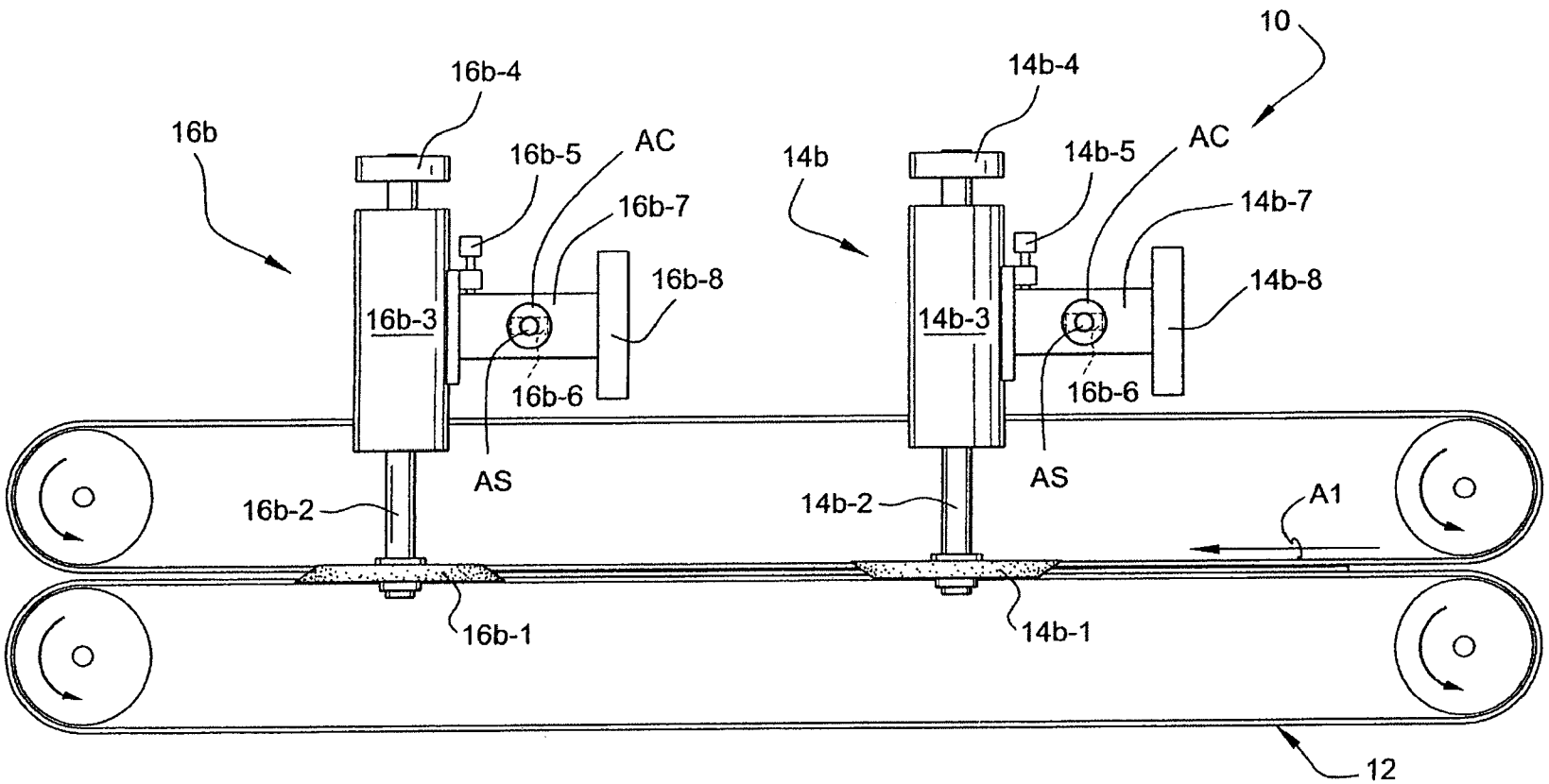
FIG. 2 is a side elevation view of the system schematically depicted in FIG. 1.
Figure 3:
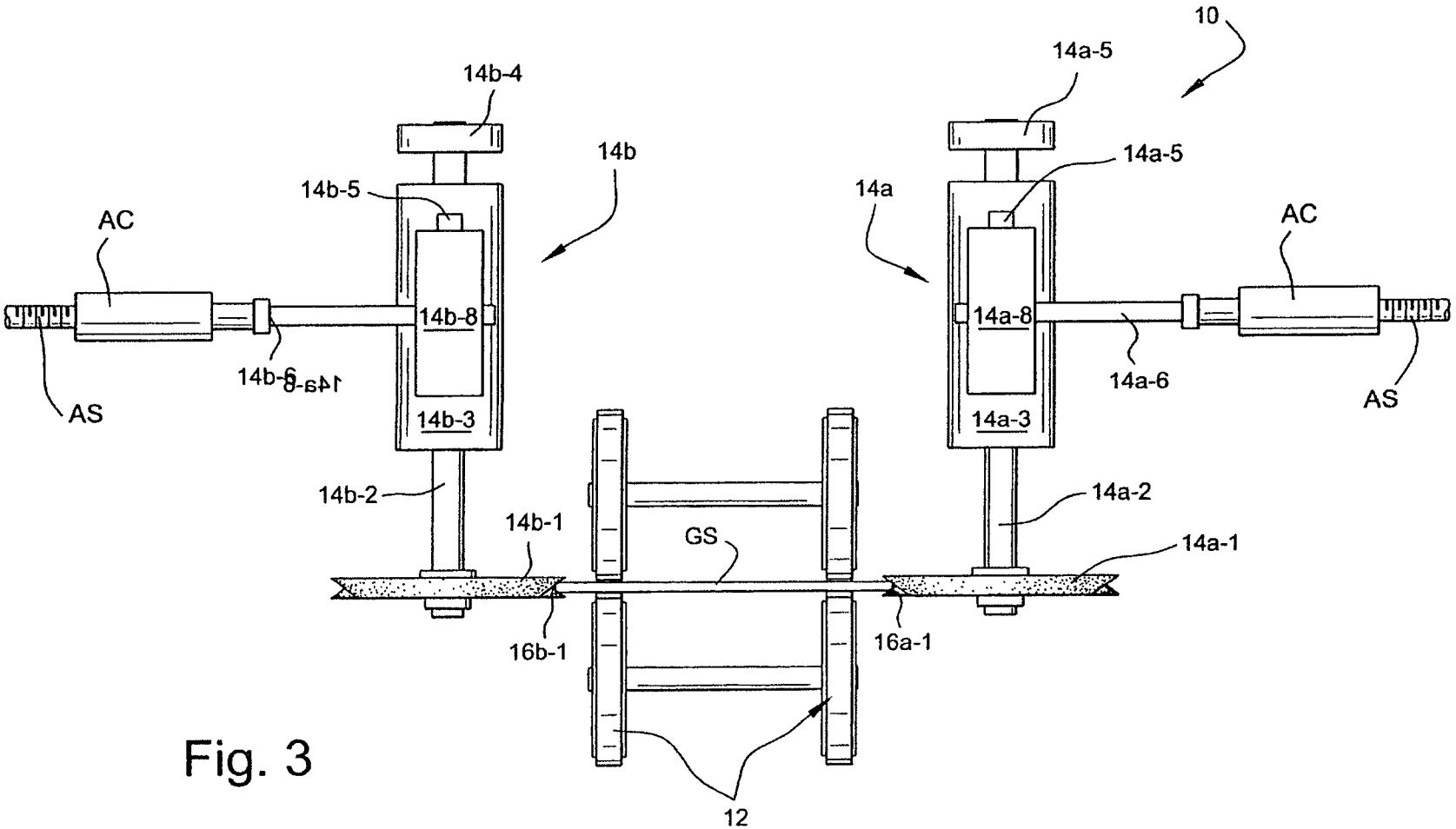
FIG. 3 is a rear elevation view of the system schematically depicted in FIG. 1.

Accompanying FIGS. 1–3 schematically depict an especially preferred system 10 for grinding the edges of glass sheets GS as the sheets are being conveyed in the direction of arrow A1 by means of a glass sheet conveyor system comprised of a lower set of support conveyor belts 12-1 and an upper set of traction conveyor belts 12-2.

Specifically, the system 10 most preferably comprises a laterally separated pair of upper edge grinding wheel assemblies 14*a*, 14*b* and a laterally separated pair of lower edge grinding wheel assemblies 16*a*, 16*b* for grinding the upper and lower edges of each lateral side of the glass sheet GS, respectively. As shown in FIG. 1, the lower edge grinding wheel assemblies 16*a*, 16*b* are spaced downstream of the upper edge grinding assemblies 14*a*, 14*b* in the conveyance direction of the glass sheet (arrow A1). However, the reverse placement could likewise be provided whereby the upper edge grinding assemblies 14*a*, 14*b* are downstream of the lower edge grinding wheel assemblies 16*a*, 16*b* relative to the conveyance direction (arrow A1) of the glass sheet GS.

Each of the grinding wheel assemblies 14*a*, 14*b* and 16*a*, 16*b* comprises a corresponding grinding wheel 14*a*-1, 14*b*-1 and 16*a*-1, 16*b*-1, respectively, having a tapered circumferential grinding surface. Although the taper angle of the circumferential grinding surface is not critical to the functioning of the present invention, for most glass sheets GS it is preferred that the taper angle be between about 25° to about 45°, preferably between about 30° to about 40°, and advantageously about 38°.

The grinding wheels 14*a*-1, 14*b*-1 and 16*a*-1, 16*b*-1 are mounted for relatively high speed revolution to a drive shaft 14*a*-2, 14*b*-2 and 16*a*-2, 16*b*-2, respectively. The shafts 14*a*-2, 14*b*-2 and 16*a*-2, 16*b*-2 are in turn coupled operatively to spindle bearing housings 14*a*-3, 14*b*-3 and 16*a*-3, 16*b*-3, respectively, so as to allow rotation of the grinding wheels 14*a*-1, 14*b*-1 and 16*a*-1, 16*b*-1 in the direction noted by arrows A2 which most preferably is in relative opposition to the conveyance direction (arrow A1) of the glass sheet GS. In addition, the bearing housings 14*a*-3, 14*b*-3 and 16*a*-3, 16*b*-3 support the shafts 14*a*-2, 14*b*-2 and 16*a*-2, 16*b*-2, respectively, for reciprocal rectilinear vertical movements (i.e., in a direction perpendicular to the upper and lower surfaces of the glass sheet GS as noted by arrow A3 in FIG. 1). Reciprocal rectilinear movements of the shafts 14*a*-2, 14*b*-2 and 16*a*-2, 16*b*-2, and hence the grinding wheels 14*a*-1, 14*b*-1 and 16*a*-1, 16*b*-1, respectively, is controlled by means of jack screw and ratchet assemblies 14*a*-4, 14*b*-4 and 16*a*-4, 16*b*-4, respectively. In such a manner, precise vertical adjustments of the grinding wheels 14*a*-1, 14*b*-1 and 16*a*-1, 16*b*-1 relative to the upper and lower edges of the glass sheets GS, respectively, may be achieved.

The upper ends of the shafts 14*a*-2, 14*b*-2 and 16*a*-2, 16*b*-2 are rigidly connected to motor driven pulleys 14*a*-1, 14*b*-1 and 16*a*-1, 16*b*-1 to allow the shafts 14*a*-2, 14*b*-2 and 16*a*-2, 16*b*-2, and hence the grinding wheels 14*a*-1, 14*b*-1 and 16*a*-1, 16*b*-1, respectively, to be rotated in the direction of arrow A2. As is conventional the pulleys 14*a*-1, 14*b*-1 and 16*a*-1, 16*b*-1 may be connected to a suitable drive motor via a belt drive (not shown).

The grinding wheel assemblies 14*a*, 14*b* and 16*a*, 16*b* are also mounted for reciprocal rectilinear horizontal movements toward and away from the lateral sides of the glass sheets (i.e., in a direction parallel to the upper and lower surfaces of the glass sheets as noted by arrow A4 in FIG. 1). In this regard, the assemblies 14*a*, 14*b* and 16*a*, 16*b* are mounted in a cantilever manner to mounting arms 14*a*-6, 14*b*-6 and 16*a*-6, 16*b*-6. The mounting arms 14*a*-6, 14*b*-6 and 16*a*-6, 16*b*-6 are in turn mounted to surrounding frame structure (not shown for clarity of presentation) to support the weight of the assemblies 14*a*, 14*b* and 16*a*, 16*b*.

Lateral arms 14*a*-7, 14*b*-7 and 16*a*-7, 16*b*-7 are connected to the support arms 14*a*-6, 14*b*-6 and 16*a*-6, 16*b*-6 respectively, so as to adjustably move the assemblies 14*a*, 14*b* and 16*a*, 16*b* in the direction of arrow A4 towards and away from the lateral sides of the glass sheet GS. A counterweight 14*a*-8, 14*b*-8 and 16*a*-8, 16*b*-8 is fixed to a terminal end of the lateral arms 14*a*-7, 14*b*-7 and 16*a*-7, 16*b*-7 so as to counter the weight of the spindle bearings 14*a*-3, 14*b*-3 and 16*a*-3, 16*b*-3 and its associated related structural components.

Horizontal movements of the lateral arms 14*a*-7, 14*b*-7 and 16*a*-7, 16*b*-7 are controllably adjusted by means of an adjustment screw AS and air cylinder AC assemblies as shown in a representative manner in FIG. 1. In this regard, adjustment of the screw will preload a compliance force on the air cylinder AC to adjustably move the respective lateral arms 14*a*-7, 14*b*-7 and 16*a*-7, 16*b*-7 to which it is attached towards and away from the edge of the glass sheet GS.

As can be seen in FIG. 3, the opposed orientation of the grinding wheels 14*a*-1, 16*a*-1 and 14*b*-1, 16*b*-1 creates a generally V-shaped profile to the laterals sides of the glass sheet GS as it is conveyed in the downstream direction of arrow A1 by means of conveyor 12. That is, the glass sheet GS first encounters the grinding wheel assemblies 14*a*, 14*b* at which location the upper edge of the glass sheet GS is beveled to conform to the taper of the grinding wheels 14*a*-1, 14*b*-1. Thereafter, the glass sheet GS encounters the downstream grinding wheel assemblies 16*a*, 16*b* at which location the lower edge of the glass sheet GS is beveled to conform to the taper of the grinding wheels 16*a*-1, 16*b*-1. After the glass sheet passes downstream of the grinding wheel assemblies 16*a*, 16*b*, both the upper and lower edges of the glass sheet GS on each of its lateral sides will be opposingly beveled.

Most preferably streams of water supplied via suitable supply tubing (not shown) are employed at the grinding location between the grinding wheels 14*a*-1, 14*b*-1 and 16*a*-1, 16*b*-1, respectively, and the lateral edges of the glass sheet GS so as to cool the same and to assist in removing grinding debris that results.

It will of course be appreciated that the relative orientation and location of the upper and lower edge grinding assemblies 14*a*, 14*b* and 16*a*, 16*b* may be reversed to that shown in the accompanying drawing FIG. 1. Moreover, the upper and lower edge grinding assemblies 14*a*, 14*b* and 16*a*, 16*b* need not be laterally paired to one another. Thus, any orientation and desired arrangement may be provided in accordance with the present invention provided that one of the top and bottom edges of the glass is beveled upstream of the other of the top and bottom edges.

Figures 4A, 4B, 4C:
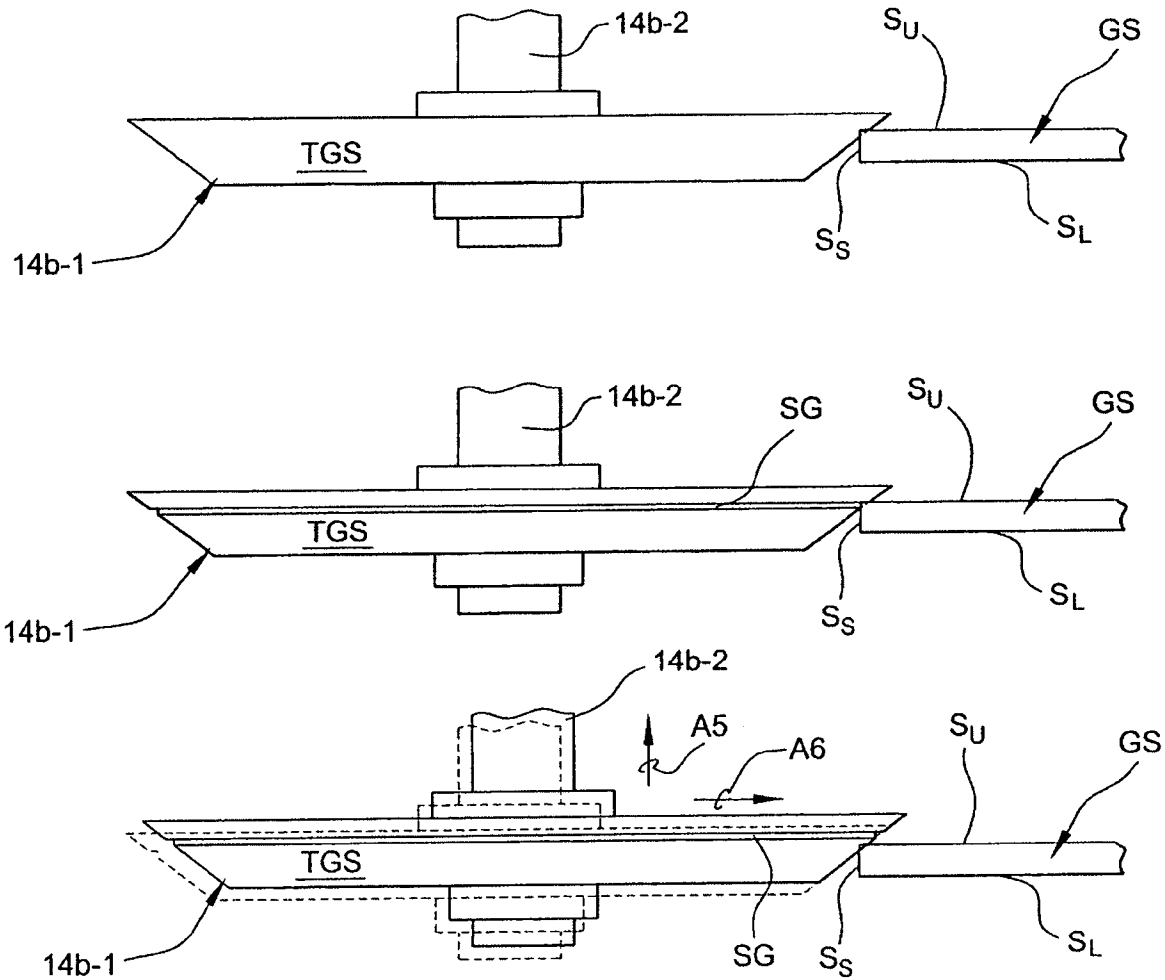
FIGS. 4A–4C depict a typical wear and adjustment cycle for a tapered grinding wheel employed in the system depicted in FIGS. 1–3.

Accompanying FIGS. 4A–4C depict schematically a typical wear and adjustment cycle for a tapered grinding wheel employed in the system depicted in FIGS. 1–3 and show the manner in which a fresh grinding surface may be presented to the edge of the glass sheet to be beveled. In this regard, the glass sheet GS having parallel upper and lower planar surfaces $S_U$ and $S_L$, a lateral side surface $S_S$ perpendicular to the surfaces $S_U$ and $S_L$ is brought into contact with one of the grinding wheels 14*a*-1, 14*b*-1 and 16*a*-1, 16*b*-1 of the edge grinding assemblies 14*a*, 14*b* and 16*a*, 16*b*, respectively. For ease of presentation, only the grinding wheel 14*b*-1 associated with the grinding assembly 14*a* is shown schematically in FIGS. 4A–4C, but its operation is equally applicable to the other grinding wheels 14*a*-1, 16*a*-1 and 16*b*-1 associated with the grinding assemblies 14*a*, 16*a* and 16*b*, respectively.

As shown in FIG. 4A, therefore, the upper edge of the glass sheet formed at the intersection of the side surface $S_S$ and the upper surface $S_U$ is brought into contact with the tapered grinding surface TGS of the grinding wheel 14*b*-1. Over time (e.g., after repetitive contact between the upper edge of the glass sheet GS and the tapered grinding surface TGS of the grinding wheel 14*b*-1, a circumferential scored groove SG will form as shown in FIG. 4B. In order to ensure that the upper edge of the glass sheet GS is ground to the correct bevel angle, the grinding wheel 14*b*-1 is adjustably moved vertically and horizontally relative to the upper edge of the glass sheet GS (arrows A5 and A6 shown in FIG. 4C) by moving the assembly 14*b* in the manner discussed above with reference to FIGS. 1–3. Such controlled adjustable movements of the grinding wheel 14*b*-1 therefore a presents a fresh unscored surface region of the tapered grinding surface TGS. Thereafter, as also shown in FIG. 4C, the upper edge of a glass sheet GS may be brought into contact with such fresh unscored surface region of the tapered grinding surface TGS so that it may be ground to the desired bevel angle.

The cycle depicted in FIGS. 4A–4C may be further repeated until there no longer remains a meaningful amount of fresh unscored surface regions associated with the tapered grinding surface TGS, at which time the worn grinding wheel 14*a*-1 may be replaced so that the tapered grinding surface TGS may be redressed. However, as compared to the duty cycle of conventional V-shaped grinding wheels, the adjustability of the grinding wheels in accordance with the present invention means that a significantly longer duty cycle can be achieved prior to grinding wheel redressing and replacement thereby enhancing productivity of the glass finishing line.

It will of course be appreciated that the discussion above with respect to grinding wheel 14*b*-1 is germane to the operation of the grinding wheels 14*a*-1, 16*a*-1 and 16*b*-1 and to the grinding of both upper and lower edges of the glass sheet on both of the later side surfaces $S_S$ thereof.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of beveling edges of glass sheets comprising:

(a) bringing one edge of a glass sheet into grinding contact with a tapered grinding surface of a first grinding wheel so that said one edge is beveled; and thereafter (b) bringing another edge of the glass sheet into contact with a tapered grinding surface of a second grinding wheel, positioned downstream of said first grinding wheel, so that said another edge of the glass sheet is beveled.

2. The method of claim 1, further comprising (c) repeating steps (a) and (b) with other glass sheets until a circumferential scored groove is formed on the tapered grinding surface of at least one of said first and second grinding wheels; and (d) adjustably moving said at least one of said first and second grinding wheels so as to present a fresh unscored region of the tapered grinding surface of said at least one of said first and second grinding wheels to said one and another edges, respectively, of the other glass sheets.

3. The method as in claim 2, wherein said at least one grinding wheel is moved vertically and horizontally relative to the glass sheet so as to present said fresh unscored region of the tapered grinding surface.

4. A method of grinding upper and lower edges along lateral sides of a glass sheet comprising:

(a) providing laterally separated pairs of upper and lower edge grinding assemblies having respective upper and lower oppositely oriented tapered grinding wheels;

(b) moving the glass sheet in a generally horizontal conveyance direction between one of said pairs of upper and lower edge grinding assemblies so that one of said upper and lower edges of the glass sheets is brought into grinding contact with one of the upper and lower tapered grinding wheels therefore, respectively, to form a bevel on said one edge; and thereafter (c) continually moving the glass sheet in the horizontal conveyance direction between the other of said pairs of upper and lower edge grinding assemblies so that the other of said upper and lower edges of the glass sheets is brought into grinding contact with the other of the upper and lower tapered grinding wheels therefore, respectively, to form a bevel on said other edge.

5. The method of claim 4, further comprising (d) repeating steps (a) and (b) with other glass sheets until a circumferential scored groove is formed on the tapered grinding surface of at least one of said upper and lower tapered grinding wheels; and (f) adjustably moving said at least one of said upper and lower tapered grinding wheels so as to present a fresh unscored region of the tapered grinding surface of said at least one of said upper and lower grinding wheels to said one of the upper and lower edges, respectively, of the other glass sheets.

6. The method as in claim 5, wherein said at least one of said upper and lower grinding wheels is moved vertically and horizontally relative to the horizontal conveyance direction of the glass sheet so as to present said fresh unscored region of the tapered grinding surface.

7. The method as in claim 1 or 4, comprising supporting the glass sheet generally horizontally relative to the grinding wheels.

8. The method of claim 7, further comprising rotating the grinding wheels about a generally vertical axis relative to the glass sheet.

9. The method of claim 1 or 4, which comprises providing grinding wheels having a tapered grinding surface of between about 20° to about 45°.

10. A system for beveling one and another opposed lateral edges of a glass sheet comprising:

a first edge grinding assembly having a first grinding wheel with a tapered grinding surface for grinding one edge of a glass sheet;

a second edge grinding assembly having a second grinding wheel with a tapered grinding surface which is oppositely oriented to and positioned downstream of said first grinding wheel;

a conveyance system for conveying a glass sheet into sequential edge-grinding contact with said tapered grinding surfaces of said first and second grinding wheels associated with said first and second grinding assemblies, respectively, so as to bevel said one and another opposed lateral edges of the glass sheet.

11. The system of claim 10, wherein the first and second edge grinding assemblies each comprise a mounting assembly for mounting the first and second edge grinding assemblies for reciprocal rectilinear movements along axes parallel and perpendicular to the glass sheet.

12. The system of claim 10 or 11, further comprising laterally separated pairs of said first and second edge grinding assemblies.

13. The system of claim 12, wherein said pair of first edge grinding assemblies bevels lateral upper edges of the glass sheet, and wherein said pair of second edge grinding assemblies bevels lateral lower edges of the glass sheet.

14. An edge grinding assembly for beveling an edge of a glass sheet, comprising:

an edge grinding wheel having a tapered grinding surface;

a shaft for mounting the grinding wheel for rotational movement so as to bevel the edge of the glass sheet in contact with the tapered grinding surface thereof;

a bearing housing for supporting the shaft and grinding wheel attached thereto for reciprocal rectilinear movements along an axis perpendicular to the glass sheet; and a mounting arm assembly for mounting the bearing housing for reciprocal rectilinear movements long an axis parallel to the glass sheet, wherein said grinding wheel may be adjustably moved along said perpendicular and parallel axes relative to said glass sheet so as to present different surface regions of the tapered grinding surface of the grinding wheel to an edge of the glass sheet to be beveled.

15. The assembly of claim 14, wherein the grinding wheel is connected to the shaft so as to grind an upper edge of a horizontally disposed glass sheet.

16. The assembly of claim 14, wherein the grinding wheel is connected to the shaft so as to grind a lower edge of a horizontally disposed glass sheet.

* * * * *